US010823018B1

(12) United States Patent
Berndt

(10) Patent No.: US 10,823,018 B1
(45) Date of Patent: Nov. 3, 2020

(54) VALVE TRAIN ARRANGEMENT INCLUDING ENGINE BRAKE SYSTEM AND LOST-MOTION HYDRAULIC LASH ADJUSTER

(71) Applicant: Schaeffler Technologies AG & Co. KG, Herzogenaurach (DE)

(72) Inventor: Eric Berndt, Whitefish Bay, WI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/451,699

(22) Filed: Jun. 25, 2019

(51) Int. Cl.
*F01L 13/00* (2006.01)
*F01L 13/06* (2006.01)
*F01L 1/24* (2006.01)

(52) U.S. Cl.
CPC ..... *F01L 13/06* (2013.01); *F01L 1/2411* (2013.01)

(58) Field of Classification Search
CPC ..... F01L 1/143; F01L 1/181; F01L 1/2411; F01L 1/25; F01L 1/267; F01L 1/46; F01L 2001/467; F01L 13/06
USPC .. 123/90.16, 90.2, 90.39, 90.4, 90.46, 90.55
See application file for complete search history.

(56) References Cited

U.S. PATENT DOCUMENTS 4,384,558 A 5/1983 Johnson
4,475,500 A 10/1984 Bostelman
4,881,499 A 11/1989 Dietrich et al.
6,189,504 B1 * 2/2001 Israel ..... F01L 13/06 123/321
6,293,248 B1 9/2001 Zsoldos et al.
9,115,654 B2 8/2015 Schnell
2002/0035978 A1 3/2002 Usko
2003/0010305 A1 1/2003 Genise
2011/0079195 A1 * 4/2011 Dilly ..... F01L 1/24 123/321
2011/0220052 A1 9/2011 Sailer et al.
2011/0220062 A1 9/2011 Sailer et al.
2014/0020644 A1 * 1/2014 Roberts ..... F01L 1/18 123/90.46
2015/0122220 A1 * 5/2015 Cecur ..... F01L 1/24 123/321
2015/0159520 A1 * 6/2015 Cecur ..... F01L 1/267 123/90.12

(Continued)

FOREIGN PATENT DOCUMENTS

DE 102010008928 A1 8/2011
DE 102010011455 A1 9/2011

(Continued)

*Primary Examiner* — Jorge L Leon, Jr.
(74) *Attorney, Agent, or Firm* — Volpe Koenig

(57) ABSTRACT

A valve train arrangement is disclosed. The arrangement includes at least one exhaust valve and a support arranged adjacent to the at least one exhaust valve 4 and configured to engage a lobe defined on a camshaft. A lost-motion hydraulic lash adjuster (LMHLA) is positioned within the support, and the LMHLA is configured to adjust lash between the support and the at least one exhaust valve. An engine brake system is configured to engage the at least one exhaust valve, such that: (i) upon activation of the engine brake system, the engine brake system engages the at least one exhaust valve to open the at least one exhaust valve; and (ii) upon deactivation of the engine brake system, the engine brake system disengages the at least one exhaust valve such that the at least one exhaust valve is closed.

13 Claims, 10 Drawing Sheets

(56) References Cited

U.S. PATENT DOCUMENTS

| | | | | |
|---|---|---|---|---|
| 2016/0146074 | A1 | 5/2016 | Lynch | |
| 2016/0356187 | A1* | 12/2016 | Meneely | F01L 13/06 |
| 2017/0175597 | A1* | 6/2017 | Cecur | F01L 1/16 |
| 2018/0003088 | A1* | 1/2018 | Nielsen | F01L 13/0036 |
| 2019/0010835 | A1* | 1/2019 | McCarthy, Jr. | F16K 15/183 |
| 2019/0145289 | A1* | 5/2019 | Ferreira | F01L 1/255 123/90.55 |
| 2019/0178113 | A1* | 6/2019 | McCarthy, Jr. | F01L 1/20 |
| 2019/0309664 | A1* | 10/2019 | Batcheller | F01L 1/181 |

FOREIGN PATENT DOCUMENTS

| | | | |
|---|---|---|---|
| DE | 102013215622 | A1 | 2/2015 |
| JP | H08284620 | A | 10/1996 |
| WO | 2008116710 | A1 | 10/2008 |

* cited by examiner

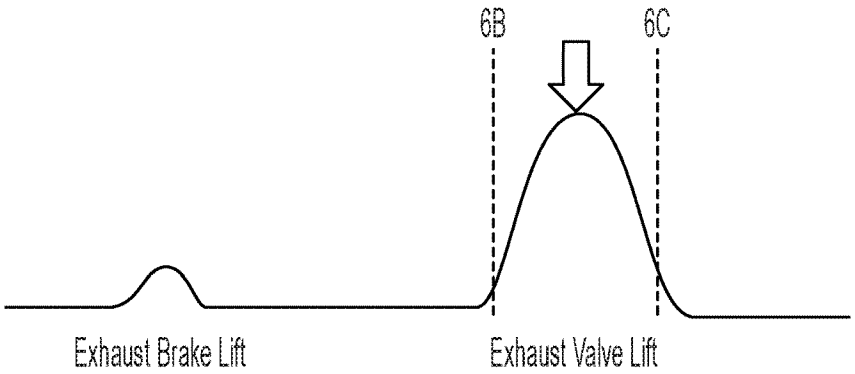
FIG. 6A
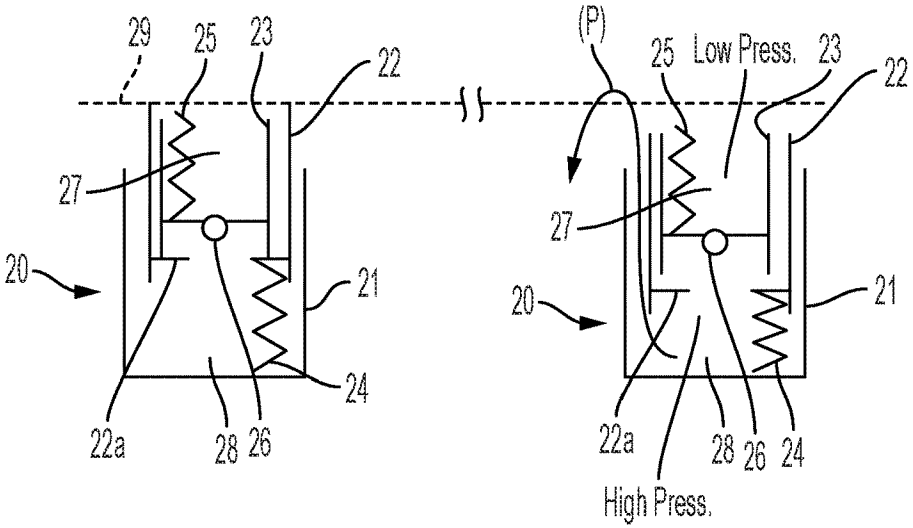
FIG. 6B
FIG. 6C
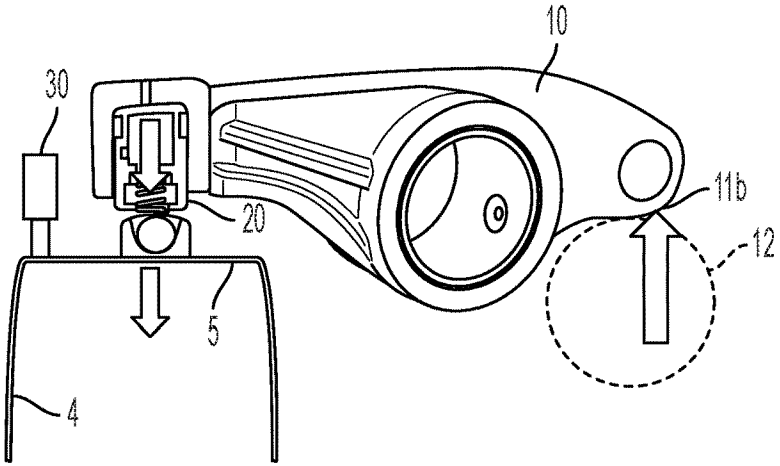
FIG. 6D

VALVE TRAIN ARRANGEMENT INCLUDING ENGINE BRAKE SYSTEM AND LOST-MOTION HYDRAULIC LASH ADJUSTER

FIELD OF INVENTION

The present invention relates to a valve train arrangement, and is more particularly related to valve train arrangement including an engine brake system and lost-motion hydraulic lash adjuster.

BACKGROUND

Existing engine compressing braking systems typically require applying a direct force to a valve or valve bridge, which creates lash. For hydraulic valve trains, a hydraulic lash adjuster (HLA) can be provided to compensate for this lash. However, known HLAs in valve train arrangements including engine braking systems cause the exhaust valve to remain open after an engine braking event. Essentially, the HLA will expand to accommodate lash that the HLA perceives in the valve train arrangement caused by the engine exhaust valve opening, but then be unable to compress as the exhaust valve closes after the engine braking event.

There are a variety of types of HLAs, including conventional HLAs, reverse spring HLAs (RSHLA), and lost-motion HLAs (LMHLA). A conventional HLA typically includes a valve assembly including a closing body that is biased closed. If a compressive force is applied to a conventional HLA, the valve assembly remains closed and the conventional HLA will be stiff, e.g. hydraulic fluid is held in the high pressure chamber and the HLA acts as a vertical column. In this mode, the conventional HLA will only compress as fast as oil is able to pass through a leakage gap.

When HLAs or RSHLAs are used in a valve train arrangement with an engine braking system, they can cause the exhaust valve to remain open after the engine braking event, causing damage to the engine or rendering the engine inoperable.

It would be desirable to provide a valve train arrangement including an engine braking assembly that also includes a HLA.

SUMMARY

A valve train arrangement is disclosed. The arrangement includes at least one exhaust valve and a support arranged adjacent to the at least one exhaust valve and configured to engage a lobe defined on a camshaft. A lost-motion hydraulic lash adjuster (LMHLA) is positioned within the support, and the LMHLA is configured to adjust lash between the support and the at least one exhaust valve. An engine brake system is configured to engage the at least one exhaust valve, such that: (i) upon activation of the engine brake system, the engine brake system engages the at least one exhaust valve to open the at least one exhaust valve; and (ii) upon deactivation of the engine brake system, the engine brake system disengages the at least one exhaust valve such that the at least one exhaust valve is closed.

In one embodiment, the LMHLA includes: an outer housing; an intermediate plunger positioned within the outer housing and defining a landing; a lost-motion plunger positioned within the intermediate plunger and configured to engage the landing; a return spring engaged against the outer housing and the intermediate plunger; a lost-motion spring engaged against the lost-motion plunger and a top surface; and a valve assembly positioned within the lost-motion plunger and separating the LMHLA into an upper chamber and a lower chamber.

In one embodiment, in a base circle mode, a lost-motion stroke is defined as a first distance between end surfaces of the lost-motion plunger and the intermediate plunger. Upon activation of the engine brake system, an exhaust brake stroke is defined by displacement of the at least one exhaust valve by a second distance, and the first distance of the lost-motion stroke is greater than or equal to the second distance of the exhaust brake stroke. In one embodiment, this relationship is affected by the geometry of the support relative to the camshaft and the at least one exhaust valve.

In one embodiment, the LMHLA is in an extended position after activation of the engine brake system. The LMHLA moves from the extended position to a compressed position upon the engine brake system transitioning from activation to deactivation.

A method of accommodating lash in a valve train including an engine braking system is also disclosed. The method includes arranging a lost-motion hydraulic lash adjuster (LMHLA) between (i) a support engaging a lobe defined on a camshaft, and (ii) at least one exhaust valve; activating an engine brake system during an exhaust brake event to drive the at least one exhaust valve to an open position, wherein the LMHLA expands to maintain contact with the support and the at least one exhaust valve; and deactivating the engine brake system such that engine brake system disengages from the at least one exhaust valve, and the LMHLA compresses as the at least one exhaust valve returns to a closed position while the LMHLA maintains contact with the support and the at least one exhaust valve.

Additional embodiments are disclosed herein.

BRIEF DESCRIPTION OF THE DRAWINGS

The foregoing Summary and the following Detailed Description will be better understood when read in conjunction with the appended drawings, which illustrate a preferred embodiment of the invention. In the drawings:

FIG. 6A illustrates a lifting profile during an exhaust valve lift event (i.e. valve opening mode).

FIG. 6B illustrates a schematic view of the LMHLA during the beginning of a lift event.

FIG. 6C illustrates a schematic view of the LMHLA at the end of a lift event.

FIG. 6D is a view of the valve train arrangement during a valve opening mode.

DETAILED DESCRIPTION OF THE PREFERRED EMBODIMENTS

Figure 1:
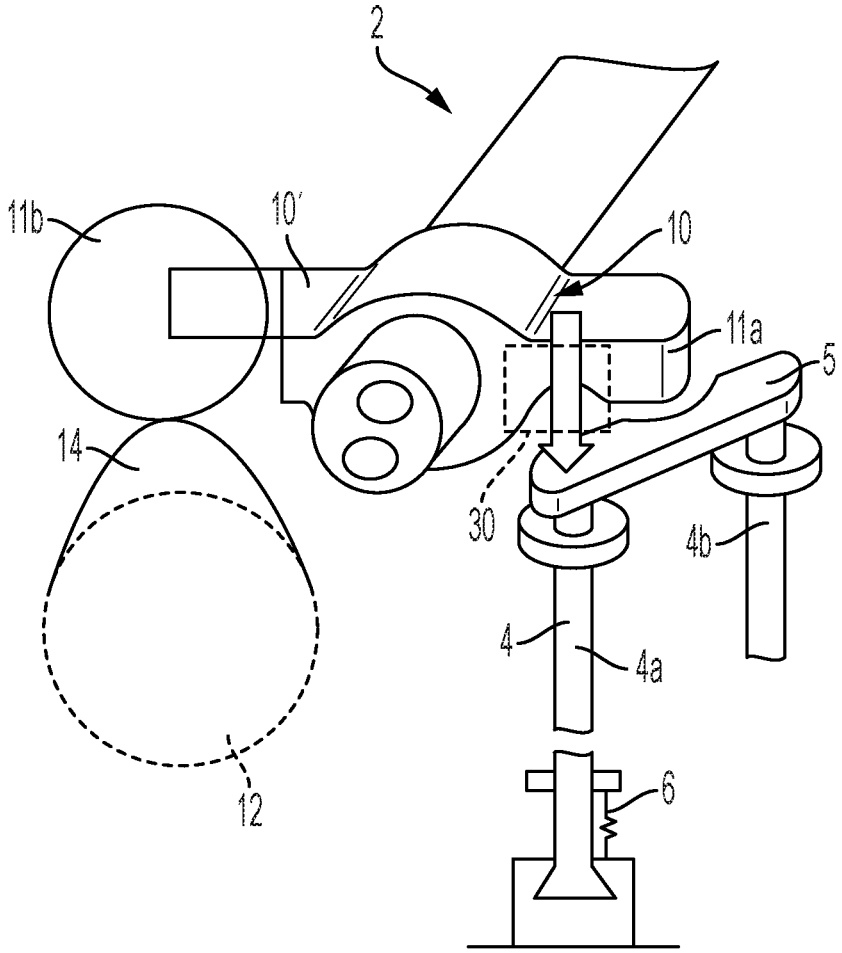
FIG. 1 is a view of a valve train arrangement according to one embodiment.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

A valve train arrangement 2 is generally disclosed and shown in FIG. 1. The arrangement 2 includes at least one exhaust valve 4, including a stem 4*a*, which is configured to open and close. A support 10 is arranged adjacent to the at least one exhaust valve 4 and is configured to engage a lobe 14 defined on a camshaft 12. The term support 10 is used generally herein to refer to a rocker arm 10' or a lifter 10". The support 10 defines a cavity 11*a*, which is adapted to hold a hydraulic lash adjuster described in more detail herein. The support 10 can include a hydraulic fluid circuit adapted to provide pressurized hydraulic fluid to the cavity 11*a*.

As shown in FIGS. 2A, 2B, 3A, 3B, 3C and 3D, a lost-motion hydraulic lash adjuster (LMHLA) 20 is illustrated in more detail. The LMHLA 20 includes an outer housing 21, an intermediate plunger 22 positioned within the outer housing 21 and defining a landing 22*a*, and a lost-motion plunger 23 positioned within the intermediate plunger 22 and configured to engage the landing 22*a*. A return spring 24 is engaged against the outer housing 21 and the intermediate plunger 22. The return spring 24 generally biases the LMHLA 20 to its expanded state. A lost-motion spring 25 is positioned between a top surface 29 and engages against the lost-motion plunger 23. The term top surface 29 is used generically herein to refer to a top surface adapted to engage with the lost-motion spring 25, the intermediate plunger 22 and the lost-motion plunger 23.

Figure 2A:
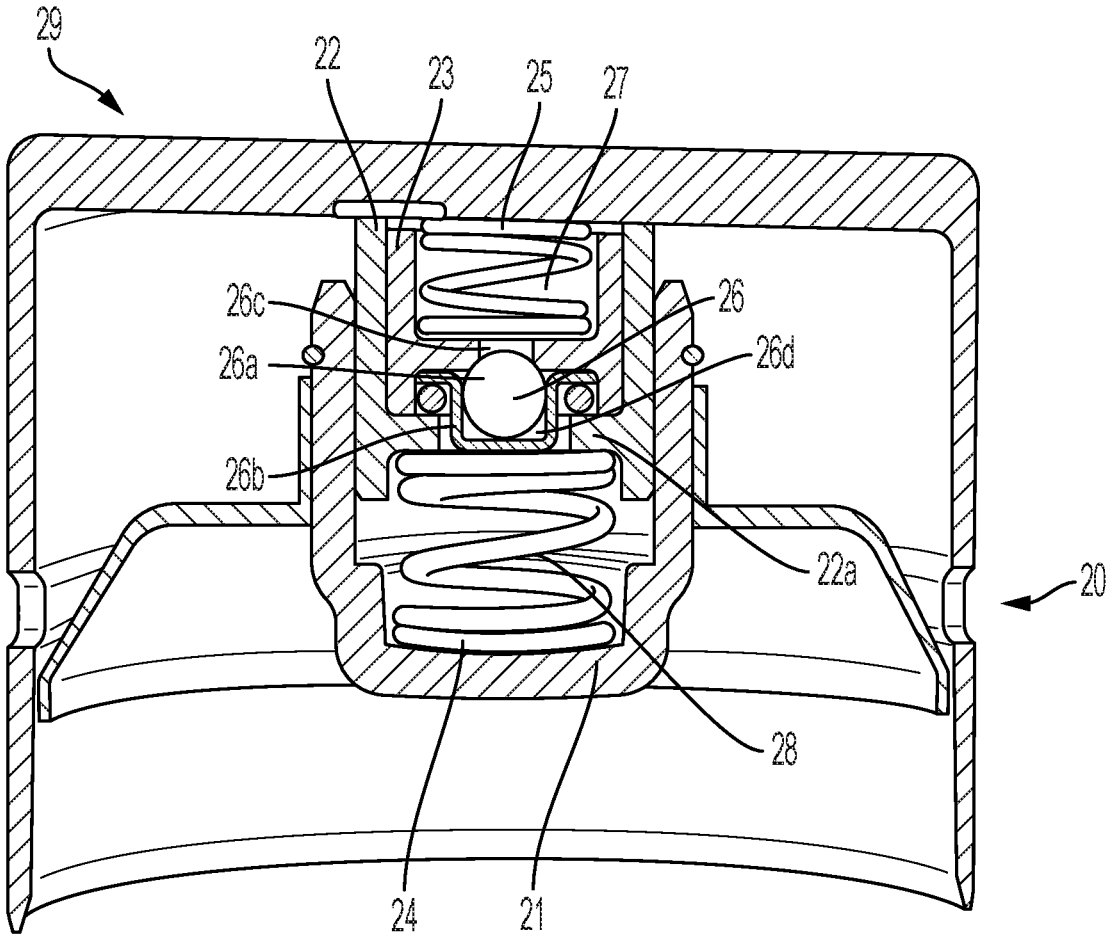
FIG. 2A is a magnified side cross-sectional view of a LMHLA for the valve train arrangement of FIG. 1.
Figure 2B:
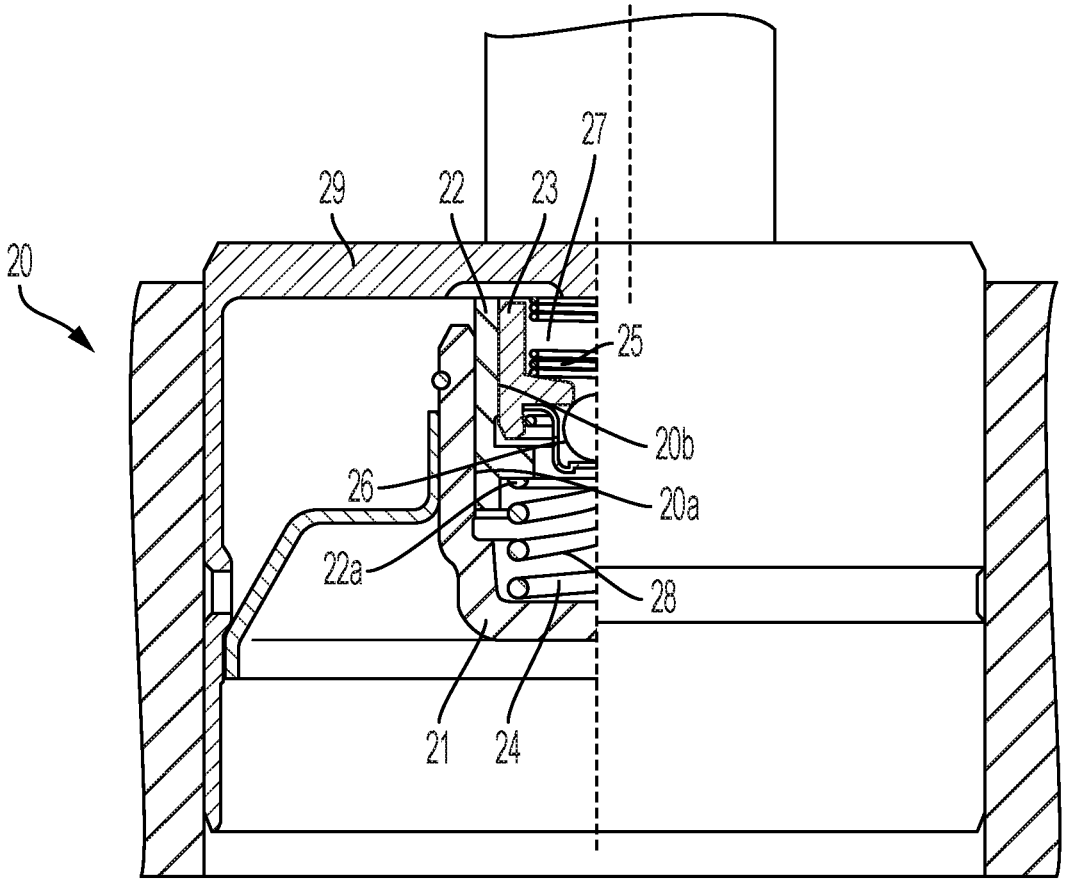
FIG. 2B illustrates an alternative view of the LMHLA of FIG. 2A.

The LMHLA 20 includes a valve assembly 26 positioned within the lost-motion plunger 23 and separating the LMHLA 20 into an upper chamber 27 and a lower chamber 28. The valve assembly 26 can include known valve components, such as a valve body 26*a*, retainer 26*b*, opening 26*c*, and valve spring 26*d*, as shown in FIG. 2A. The opening 26*c* is ordinarily closed by the valve spring 26*d* biasing the valve body 26*a*. The valve assembly 26 is only opened in the conditions explained in further detail below with respect to FIGS. 7C and 8C.

The LMHLA 20 includes a first leakage gap 20*a* and a second leakage gap 20*b*. Features of an LMHLA 20 are generally known as being disclosed in US Publication 2015/0122220, which is incorporated by reference as if fully set forth herein.

Figure 3D:
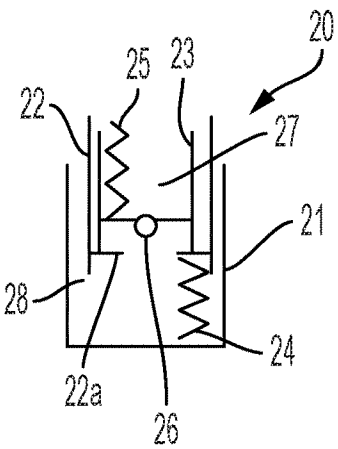
FIGS. 3A-3D illustrate the LMHLA in a variety of operational states based on a position of a cam profile or engine braking profile.
Figure 3C:
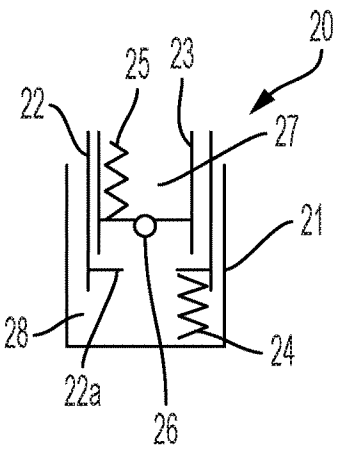
Figure 3B:
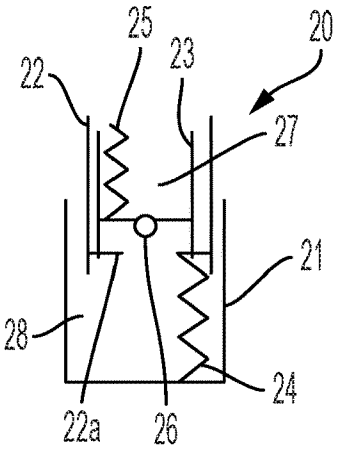
Figure 3A:
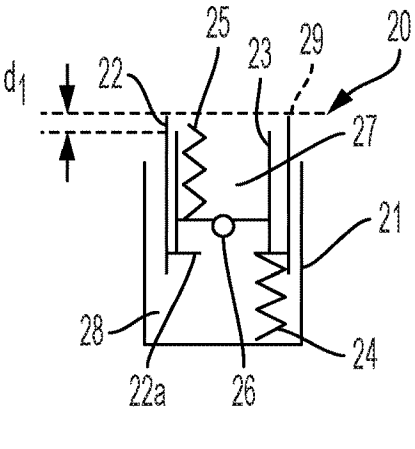

As shown in FIG. 3A, a distance (d1) is defined as a height difference between upper ends of the intermediate plunger 22 and the lost-motion plunger 23. This distance (d1) is defined as a lost-motion stroke for the LMHLA 20. This distance (d1) is also referred to as a lost-motion plunger distance. Generally, as the LMHLA 20 compresses, relative motion occurs between the lost-motion plunger 23 and the intermediate plunger 22, such that the upper edges of the lost-motion plunger 23 and the intermediate plunger 22 become aligned. The lost-motion plunger 23 is engaged with the landing 22*a* defined on the intermediate plunger 22 in an initial state, as shown in FIG. 3A, which generally corresponds to the expanded state of the LMHLA 20 and a base circle mode. As the LMHLA 20 compresses, the lost-motion plunger 23 disengages from the landing 22*a* of the intermediate plunger 22 and travels upward. Varying states and phases of the LMHLA 20 during the engine braking event is described in more detail herein.

FIG. 3A illustrates a base circle mode of the LMHLA 20. FIG. 3B illustrates the LMHLA 20 in an expanded state during an exhaust braking lift event. FIG. 3C illustrates the LMHLA 20 and the lost-motion plunger 23/lost-motion spring 25 compressed immediately after an exhaust valve lift event or an exhaust braking event. FIG. 3D illustrates the LMHLA 20 back in a base circle mode following the exhaust braking event.

An engine brake system 30 is configured to engage the exhaust valve 4. The engine brake system 30 is schematically illustrated in the drawings. In one embodiment, the engine brake system 30 can include a lobed shaft. In another embodiment, the engine brake system 30 can include an actuator, such as a linear actuator or solenoid. One of ordinary skill in the art would understand from the present disclosure that the exact configuration of the engine brake system 30 can be varied. Once the engine brake system 30 is actuated, then the engine brake system 30 engages the exhaust valve 4 to open the exhaust valve 4. This process is known as engine braking, which is described in more detail in U.S. Publications 2011/0220062 and 2016/0146074 (which are incorporated by reference as set forth herein).

The engine brake system 30 can engage directly against a stem for the exhaust valve 4 or engage a bridge 5 connected to the exhaust valve 4. As used herein, the term exhaust valve 4 can generally refer only to the exhaust valve 4 or the exhaust valve 4 and an associated bridge 5.

Figure 4:
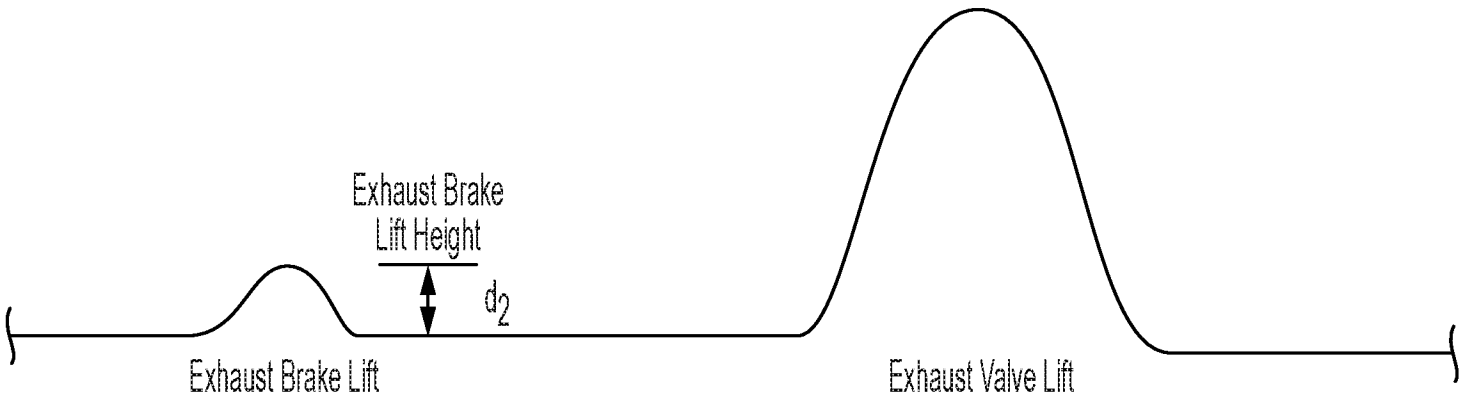
FIG. 4 illustrates a lift profile for an exhaust valve.

Upon deactivation of the engine brake system 30, the engine brake system 30 disengages the exhaust valve 4. The exhaust valve 4 (or its stem) is biased closed by a valve closing spring 6, shown schematically in FIG. 1. As shown in the lifting profile of the exhaust valve 4 in FIG. 4, a second distance (d2) is defined as the exhaust brake lift height, which corresponds to the distance that the engine brake system 30 moves the exhaust valve 4 or bridge 5 during the engine braking event. This second distance (d2) is described in more detail herein.

In one embodiment, a relationship between the first distance (d1) and the second distance (d2) is 1:1. In another embodiment, the first distance (d1) is less than the second distance (d2) by a factor of up to 0.5:1, or greater than the second distance (d2) by a factor of up to 4:1, depending on the geometrical relationship between the camshaft 12, fulcrum location of the support 10, and the contact point of the RSHLA 20 to the valve 4 and/or bridge 5.

In another embodiment, a relationship exists between the force of the lost motion spring 25 and size of the second leakage gap 20*b* such that the lost motion plunger 23 can return to its blocked position against the landing 22*a* in the time defined by the period when the valve 4 closes and before the start of the next valve lift event.

FIGS. 5A-9D illustrate varying positions of the LMHLA 20 according to different lift events, i.e. an exhaust valve lift event and an exhaust brake lift event.

Arrows are provided on FIGS. 5C, 6D, 7D, 8D, and 9D to represent forces between the exhaust valve 4 or bridge 5, the support 10, the LMHLA 20, and the engine brake system 30.

Figure 5A:
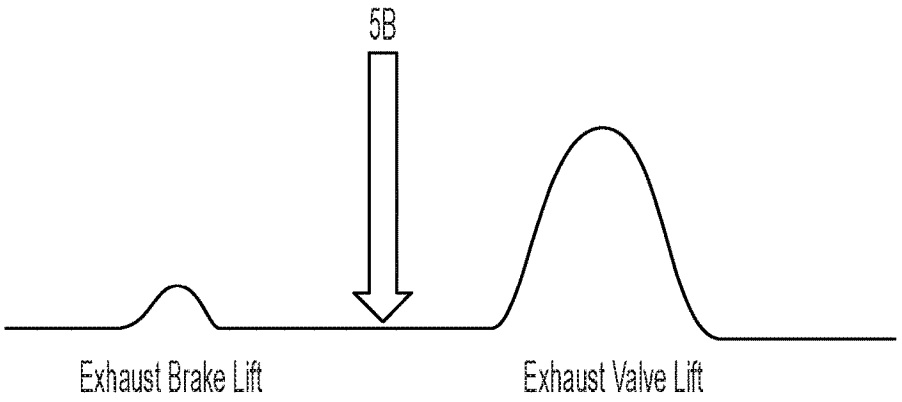
FIG. 5A illustrates a base circle mode of a lifting profile for an exhaust valve.
Figure 5C:
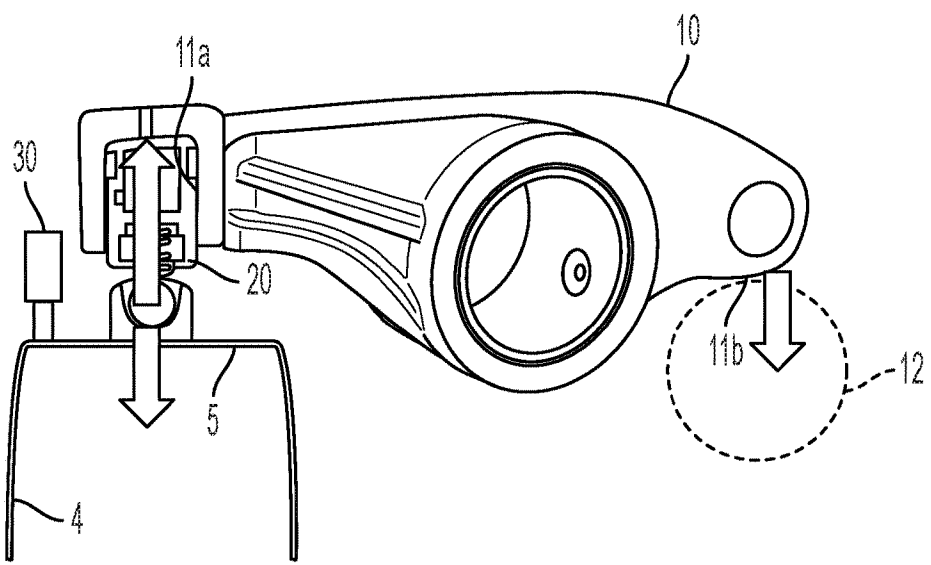
FIG. 5C is a view of the valve train arrangement during the base circle mode.
Figure 5B:
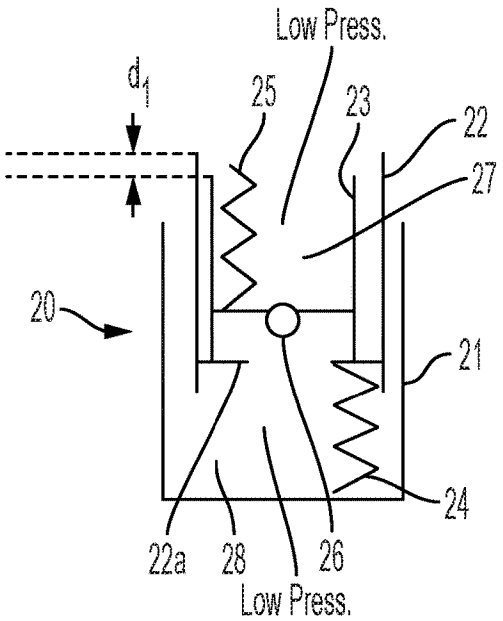
FIG. 5B illustrates a schematic view of the LMHLA during the base circle mode.

FIGS. 5A-5C illustrate a base circle mode for the valve train arrangement 2. In this condition, the LMHLA 20 expands to take up any clearance between the cam lobe 14 defined on the camshaft 12 and the exhaust valve 4, and/or bridge 5. A base of the LMHLA 20 is grounded to the exhaust valve 4 or bridge 5 in this condition. As shown in FIG. 5B, the lost-motion stroke or first distance (d1) is illustrated as the difference in height between ends of the lost-motion plunger 23 and the intermediate plunger 22.

FIGS. 6A-6D illustrate a valve opening mode for the valve train arrangement 2. In this mode, an exhaust valve cam lobe 14 defined on the camshaft 12 pushes against a cam follower lib on the support 10. As shown in FIG. 6B, the LMHLA 20 is shown at the beginning of the lift event, and FIG. 6C illustrates the LMHLA 20 at an end of the lift event, during which the LMHLA 20 is compressed based on the resulting force of the support 10 pivoting due to engagement with the exhaust valve lobe 14 formed on the camshaft 12 causing the LMHLA 20 to leak down as described below. The return spring 24 is compressed as the LMHLA 20 transitions from FIG. 6B to FIG. 6C. As shown in FIG. 6C, due to compression of the LMHLA 20, high pressure builds up in the lower chamber 28. As the LMHLA 20 compresses, the lost-motion plunger 23 becomes unseated from landing 22*a* on the intermediate plunger 22, and the lost-motion plunger 23 travels upward. During this exhaust valve lift event, the high pressure in the lower chamber 28 overcomes the force of the lost-motion spring 25 until the point when the upper edge of the lost motion plunger 23 contacts the top surface 29. At this point, as the valve assembly 26 is in a closed position, the pressure in the lower chamber 28 increases relative to the pressure in the upper chamber 27. The LMHLA 20 is now in a conventional blocked position and further downward displacement of the intermediate plunger 22 and lost motion plunger 23 relative to the outer housing 21 is controlled by the flow of fluid through first leakage gap 20*a*, and a second leakage gap 20*b*. One of ordinary skill in the art would understand that hydraulic fluid leaks out of the LMHLA 20 via these leakage gaps.

FIGS. 7A-7D illustrate a return to the base circle mode for the valve train arrangement 2. During a return to the base circle mode, the return spring 24 expands to allow the LMHLA 20 to take up the resulting clearance between the exhaust valve cam lobe 14 defined on the camshaft 12 and the exhaust valve 4 and/or bridge 5. The cam follower 11*b* is grounded to the camshaft 12, and an exhaust valve closing spring 6 (optionally through bridge 5) pushes against the base of the LMHLA 20 until the exhaust valve 4 is seated.

Figure 7A:
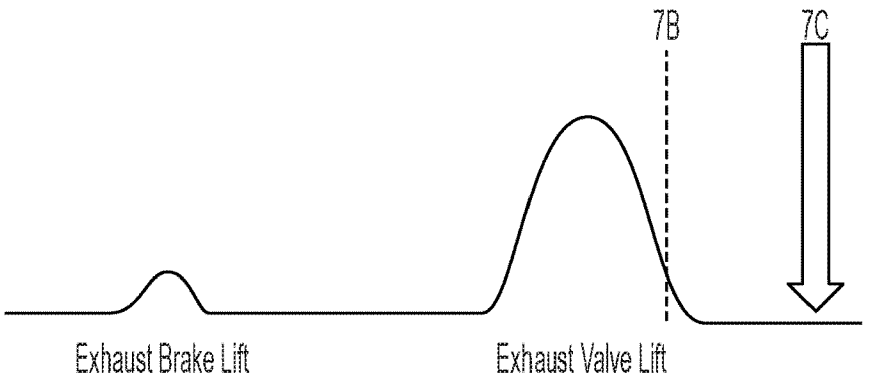
FIG. 7A is a lift profile illustrating a return to a base circle mode.
Figure 7D:
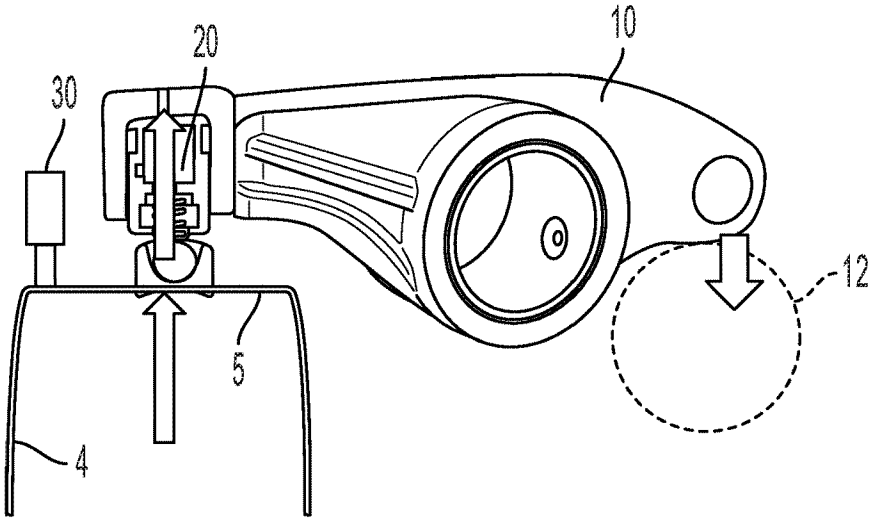
FIG. 7D is a view of the valve train arrangement during a return to the base circle.
Figure 7C:
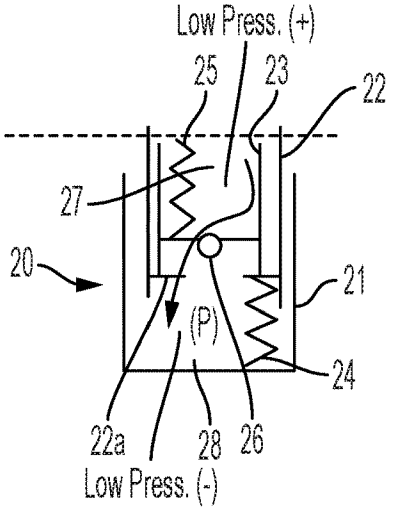
FIG. 7C illustrates a schematic view of the LMHLA during a return to the base circle.
Figure 7B:
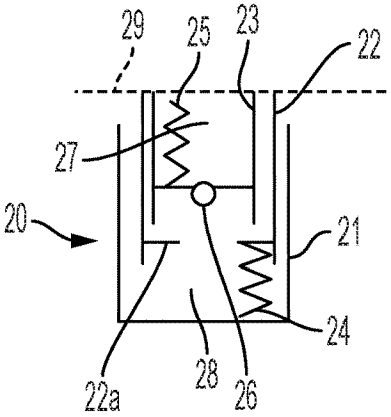
FIG. 7B illustrates a schematic view of the LMHLA during the end of a lift event.

FIG. 7B corresponds to the end of the lift event, in which the LMHLA 20 is still partially compressed (shown by return spring 24). As the compressive force is removed from the LMHLA 20, it will expand to take up lash between the support 10 and the exhaust valve 4 and bridge 5. The return spring 24 biases the LMHLA 20 to expand, as shown in FIG. 7C, which corresponds to a return to the base circle mode. In this mode, the return spring first displaces the outer housing 21 axially downward relative to the intermediate plunger 22 and lost motion plunger 23. This will create a relatively lower pressure low pressure (−) in lower chamber 28 relative to upper chamber 27 low pressure (+). The lost motion spring 25 will then cause the lost motion plunger 23 to displace axially downward relative to intermediate plunger 22 until the bottom of the lost motion plunger 23 becomes blocked against the landing 22*a* defined on the intermediate plunger 22. As shown in FIG. 7C, as the outer housing 21 continues to displace axially downward relative to the intermediate plunger 22 due to the force from return spring 24, the upper chamber 27 has low pressure (+) and the lower chamber 28 has a relatively lower low pressure (−). As a result of the pressure differential, the valve assembly 26 opens and allows hydraulic fluid to flow (P) from the upper chamber 27 to the lower chamber 28.

Figure 8A:
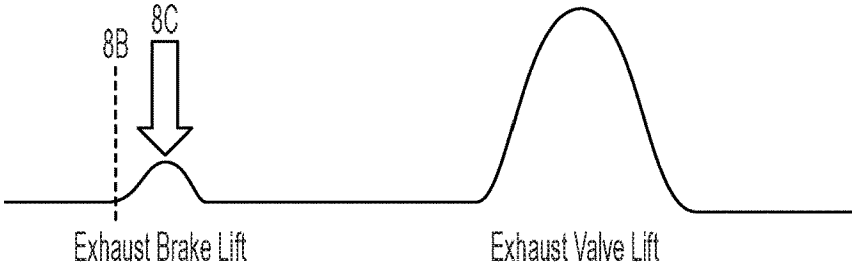
FIG. 8A illustrates a peak of an exhaust brake mode of a lift profile.
Figure 8D:
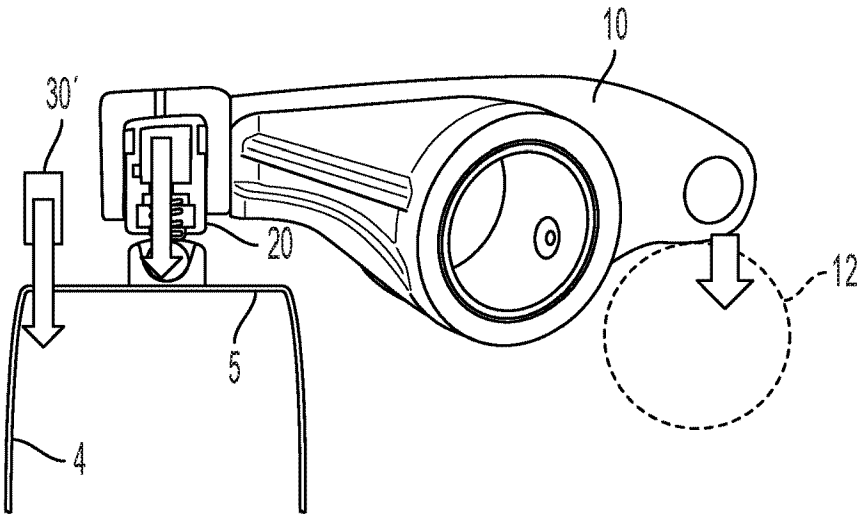
FIG. 8D is a view of the valve train arrangement during a peak of the exhaust brake mode.
Figure 8C:
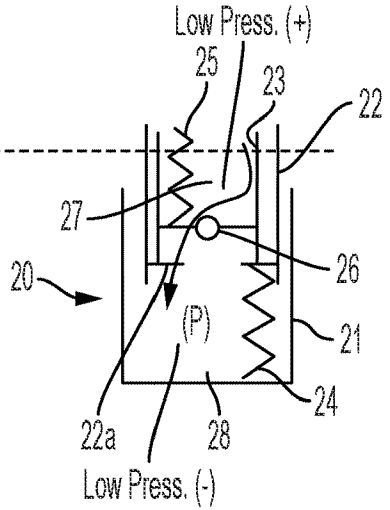
FIG. 8C illustrates a schematic view of the LMHLA during a peak of the exhaust brake event.
Figure 8B:
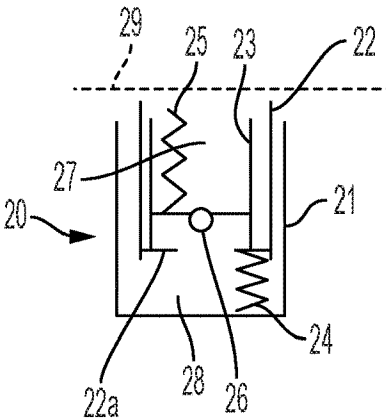
FIG. 8B illustrates a schematic view of the LMHLA during the base circle

FIGS. 8A-8D illustrate a peak of an exhaust brake mode for the valve train arrangement 2. In this mode, the engine brake system 30 is actuated (indicated by 30' in FIG. 8D) and pushes on the exhaust valve 4 (optionally through bridge 5) to open the exhaust valve 4 and provide an engine braking mode. As the engine brake system 30 presses downward on the exhaust valve 4 (optionally through bridge 5), lash is created between the support 10 and the exhaust valve 4 and/or bridge 5. As a result, the LMHLA 20 generally expands to compensate for this newly created lash. FIG. 8B is a schematic view corresponding to a base circle mode immediately before the exhaust brake event. FIG. 8C illustrates a peak of the exhaust brake event, during which the return spring 24 expands and the LMHLA 20 takes up lash. In FIG. 8C, the lower chamber 28 has a relatively lower low pressure (−) than a low pressure (+) state of the upper chamber 27, and as a result the valve assembly 26 opens to allow the flow of hydraulic fluid (P) downward from the upper chamber 27 to the lower chamber 28. As the LMHLA 20 expands, the lost-motion plunger 23 remains seated against landing 22*a* of the intermediate plunger 22.

Figure 9A:
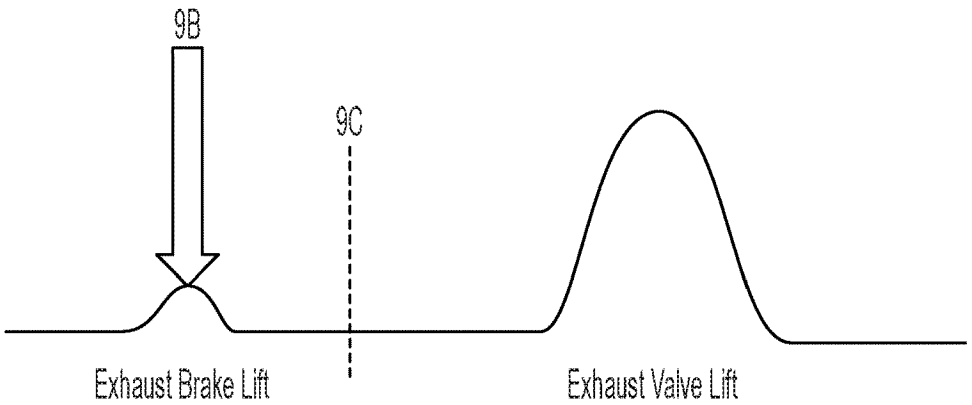
FIG. 9A illustrates a lifting profile immediately after the exhaust brake lift event.
Figure 9D:
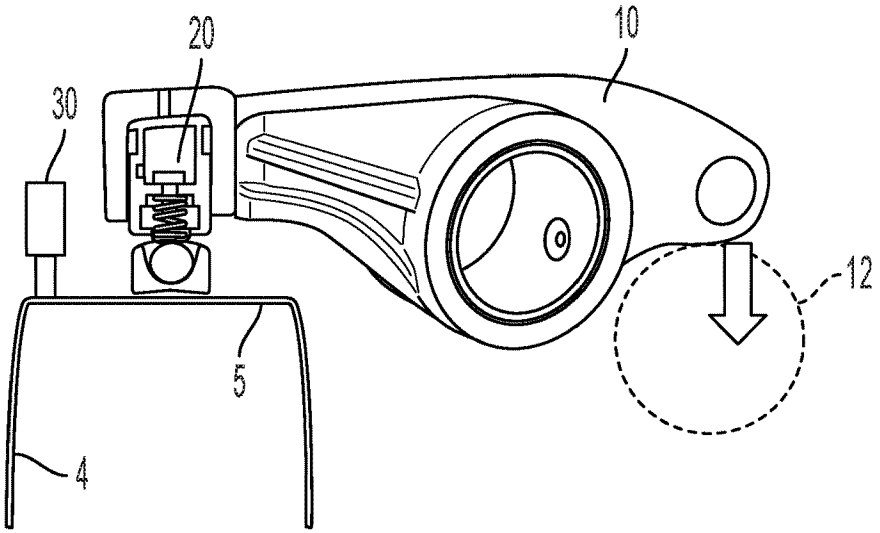
FIG. 9D is a view of the valve train arrangement returning to the base circle following an exhaust brake lift event.
Figure 9C:
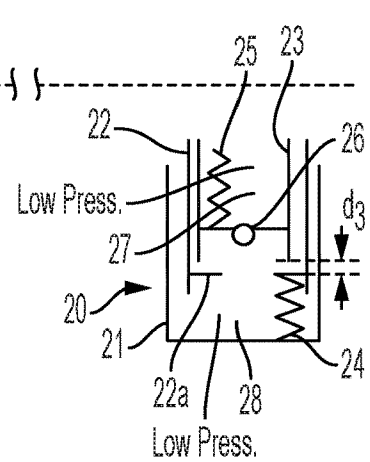
FIG. 9C illustrates a schematic view of the LMHLA during a return to the base circle.
Figure 9B:
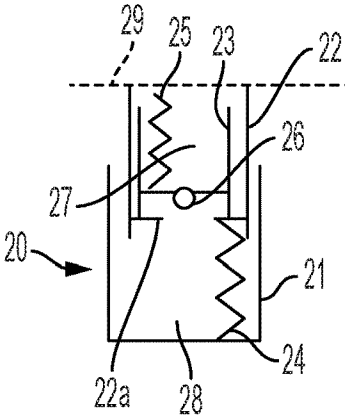
FIG. 9B illustrates a schematic view of the LMHLA during a peak of the exhaust brake event.

FIGS. 9A-9D illustrate a return to the base circle immediately after an engine braking event. FIG. 9B illustrate a condition of the LMHLA 20 at the peak of the exhaust valve brake event. During this stage, the LMHLA 20 is expanded to take up lash created by the exhaust valve brake event. As shown in FIG. 9B, the lost-motion plunger 23 remains blocked against landing 22*a* of the intermediate plunger 22 due to the lost-motion spring 25. As the engine brake system 30 is deactivated, the valve closing spring 6 pushes the LMHLA 20 back to a compressed or base circle state. In FIG. 9C, a return to the base circle is illustrated during which the LMHLA 20 is compressed so the exhaust valve 4 can close following the engine brake event. This state, which is a pre-base circle mode, transitions to the full base circle mode illustrated in FIG. 5B after the LMHLA 20 settles.

A specific relationship exists between the first distance (d1), i.e. the lost-motion stroke, and the second distance (d2), i.e. the exhaust brake lift height. The lost-motion stroke is greater than or equal to the exhaust brake lift height. In one embodiment, this relationship is affected by the geometry of the support 10 relative to the camshaft 12 and the at least one exhaust valve 4 and/or valve bridge 5. This design ensures that the lost-motion plunger 23 can compress, and avoids trapping high pressure in the lower chamber 28 after the exhaust braking event. If high pressure were to build up in the lower chamber 28, then the LMHLA 20 compresses relatively slower, and the exhaust valve 4 is held open for an unacceptable amount of time.

Generally, the lost-motion stroke is designed such that the lost-motion stroke is larger than a distance that the lost-motion plunger 23 is displaced due to the relative upward axial motion of the outer housing 21 relative to the intermediate plunger 22 when the exhaust valve 4 is disengaged from the exhaust brake system 30 and the exhaust valve 4 returns to the base circle mode position after its displacement from the exhaust brake system 30.

The lost-motion stroke is defined as a distance between first axial ends of the lost-motion plunger 23 and the intermediate plunger 22 when a second axial end of the lost-motion plunger 23 is seated against the landing 22*a* of the intermediate plunger 22. This lost-motion stroke (which corresponds to distance (d1)) must be the same value or larger than a maximum exhaust brake lift height (i.e. distance (d2)). During the exhaust brake lift event, the return spring 24 biases the outer housing 21 downward relative to the intermediate plunger 22 by a distance of the exhaust brake lift height (i.e. distance (d2)). When the exhaust brake closes (i.e. the exhaust brake system 30 deactivates), the outer housing 21 begins moving upwards relative to the intermediate plunger 22 by the distance of the exhaust brake lift height. This movement is due to the valve closing spring 6 pushing upwards on the exhaust valve 4 and/or bridge 5, which engages the LMHLA 20. Simultaneously, the lost-motion plunger 23 moves upward relative to the intermediate plunger 22 by a distance, illustrated in FIG. 9C as distance (d3), that is greater than or equal to the exhaust brake lift height to offset a displaced volume of hydraulic fluid in the lower chamber 28 (i.e. the high pressure chamber) caused by relative motion of the outer housing 21. As this occurs, the lost-motion spring 25 also pushes the lost-motion plunger 23 downward relative to the intermediate plunger 22 until the lost-motion plunger 23 is seated back on the landing 22*a* of the intermediate plunger 22 and the LMHLA 20 returns to its base circle mode. The embodiments disclosed herein are designed such that there is adequate time for lost-motion plunger 23 to return to its seated position on the landing 22*a* of the intermediate plunger 22 prior to the start of the next valve lift event.

One of ordinary skill in the art would understand that each of the variables and relationships described above between the distances (d1), (d2), and (d3) can be affected by the geometry of the support 10 relative to the camshaft 12 and the at least one exhaust valve 4 and/or valve bridge 5.

One of ordinary skill in the art would understand that the LMHLA 20 can engage directly with components of the exhaust valve 4 and/or bridge 5 and the support 10, or the LMHLA 20 can engage with intermediate components and have an indirect engagement with the exhaust valve 4 and/or bridge 5 and the support 10.

As described herein, the present disclosure generally describes a system and method in which a LMHLA 20 is integrated into a valve train arrangement 2 and the LMHLA allows the exhaust valve 4 to close in an expedient manner following an engine braking event. The exhaust valve 4 closes fast enough to avoid interruption of the lift profile associated with normal operation of the engine. In other words, the exhaust valve 4 is not held open for a prolonged period, which would adversely affect the engine combustion process or result in mechanical interference between the exhaust valve 4 and the reciprocating piston in the engine cylinder.

In another embodiment, a method of accommodating lash in a valve train including an engine braking system is provided. The method includes arranging a LMHLA 20 between (i) a support 10 engaging a lobe 14 defined on a camshaft 12, and (ii) an exhaust valve 4 (either directly or via a bridge 5). The method includes activating the engine brake system 30 to drive the exhaust valve 4 to an open position, and the LMHLA 20 expands to maintain contact with the support 10 and the exhaust valve 4. The method includes deactivating the engine brake system 30 such that engine brake system 30 disengages from the exhaust valve 4, and the LMHLA 20 compresses as the exhaust valve 4 returns to a closed position while the LMHLA 20 maintains contact with both the support 10 and the exhaust valve 4.

In one embodiment, the lost-motion plunger 23 is seated against the landing 22*a* of the intermediate plunger 22 at a peak of the exhaust brake event, the lost-motion plunger 23 is driven off of the landing 22*a* of the intermediate plunger 22 (due to high pressure building up in the lower chamber 28) during a transitional phase immediately after the peak of the exhaust brake event, the lost-motion plunger 23 returns to the landing 22*a* of the intermediate plunger 22 after the transitional phase during a base circle mode.

One of ordinary skill in the art would understand that a ratio between the displacement that occurs due to the exhaust brake system 30 and the lost-motion stroke can be 1:1 or the ratio can vary. In other words, there may not be a direct relationship between these two values due to a variety of factors, such as valve train geometry.

Having thus described the present invention in detail, it is to be appreciated and will be apparent to those skilled in the art that many physical changes, only a few of which are exemplified in the detailed description of the invention, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LOG OF REFERENCE NUMERALS valve train arrangement 2
exhaust valve 4
bridge 5
valve closing spring 6
support 10
cavity 11*a*
cam follower 11*b*
camshaft 12
lobe 14
LMHLA 20
first leakage gap 20*a*
second leakage gap 20*b*
outer housing 21 intermediate plunger 22
landing 22*a*
lost-motion plunger 23
return spring 24
lost-motion spring 25
valve assembly 26
upper chamber 27
lower chamber 28
top surface 29
engine brake system 30

What is claimed is:

1. A valve train arrangement comprising:

at least one exhaust valve;

a support arranged adjacent to the at least one exhaust valve and configured to engage a lobe defined on a camshaft, the support defining a cavity;

a lost-motion hydraulic lash adjuster (LMHLA) positioned within the cavity of the support, the LMHLA configured to adjust lash between the support and the at least one exhaust valve, the LMHLA including:

an outer housing;

an intermediate plunger positioned within the outer housing and defining a landing at a first axial end of the intermediate plunger, and a second axial end of the intermediate plunger configured to engage a top inner surface of the LMHLA;

a lost-motion plunger positioned within the intermediate plunger and configured to engage the landing;

a return spring engaged against the outer housing and the intermediate plunger;

a lost-motion spring engaged against the lost-motion plunger and the top inner surface; and a valve assembly positioned within the lost-motion plunger and separating the LMHLA into an upper chamber and a lower chamber, such that the intermediate plunger and the lost-motion plunger are both configured to directly engage the top inner surface, and a height difference defined as a first distance between an upper edge of the lost-motion plunger and the second axial end of the intermediate plunger when the lost-motion plunger is seated on the landing of the intermediate plunger defines a lost-motion stroke of the LMHLA;

an engine brake system configured to engage the at least one exhaust valve, such that:

(i) upon activation of the engine brake system, the engine brake system engages the at least one exhaust valve such that the at least one exhaust valve is opened; and (ii) upon deactivation of the engine brake system, the engine brake system disengages the at least one exhaust valve such that the at least one exhaust valve is closed.

2. The valve train arrangement of claim 1, wherein upon activation of the engine brake system, an exhaust brake stroke is defined by displacement of the at least one exhaust valve by a second distance, and the first distance of the lost-motion stroke is greater than or equal to the second distance of the exhaust brake stroke.

3. The valve train arrangement of claim 1, wherein the LMHLA is in an extended position after activation of the engine brake system.

4. The valve train arrangement of claim 3, wherein the LMHLA moves from the extended position to a compressed position upon the engine brake system transitioning from activation to deactivation.

5. The valve train arrangement of claim 1, wherein the support is at least one of: a lifter; a rocker arm; or a finger follower.

6. The valve train arrangement of claim 1, wherein the at least one exhaust valve is supported in an exhaust valve bridge.

7. The valve train arrangement of claim 1, wherein the engine brake system includes at least one of: an actuator or a lobed shaft.

8. A method of accommodating lash in a valve train including an engine braking system, the method comprising:

arranging a lost-motion hydraulic lash adjuster (LMHLA) between (i) a support engaging a lobe defined on a camshaft, and (ii) at least one exhaust valve, the LMHLA including:

an outer housing;

an intermediate plunger positioned within the outer housing and defining a landing at a first axial end of the intermediate plunger, and a second axial end of the intermediate plunger configured to engage a top inner surface of the LMHLA;

a lost-motion plunger positioned within the intermediate plunger and configured to engage the landing;

a return spring engaged against the outer housing and the intermediate plunger;

a lost-motion spring engaged against the lost-motion plunger and the top inner surface; and a valve assembly positioned within the lost-motion plunger and separating the LMHLA into an upper chamber and a lower chamber, such that the intermediate plunger and the lost-motion plunger are both configured to directly engage the top inner surface, and a height difference defined as a first distance between an upper edge of the lost-motion plunger and the second axial end of the intermediate plunger when the lost-motion plunger is seated on the landing of the intermediate plunger defines a lost-motion stroke of the LMHLA;

activating an engine brake system during an exhaust brake event so as to drive the at least one exhaust valve to an open position, wherein the LMHLA expands so as to maintain contact with the support and the at least one exhaust valve; and deactivating the engine brake system such that the engine brake system disengages from the at least one exhaust valve, and the LMHLA compresses as the at least one exhaust valve returns to a closed position while the LMHLA maintains contact with the support and the at least one exhaust valve.

9. The method of claim 8, wherein upon activation of the engine brake system, an exhaust brake stroke is defined by displacement of the at least one exhaust valve by a second distance, and the first distance of the lost-motion stroke is greater than or equal to the second distance of the exhaust brake stroke.

10. The method of claim 8, wherein the LMHLA is in an extended position after activation of the engine brake system, and the LMHLA transitions from the extended position to a compressed position upon the engine brake system transitioning from activation to deactivation.

11. The method of claim 8, wherein the lost-motion plunger is seated against the landing of the intermediate plunger at a peak of the exhaust brake event.

12. The method of claim 11, wherein the lost-motion plunger is driven off of the landing of the intermediate plunger during a transitional phase immediately after the peak of the exhaust brake event.

13. The method of claim 12, wherein the lost-motion plunger returns to the landing of the intermediate plunger after the transitional phase during a base circle mode.

* * * * *